US007469115B2

(12) United States Patent
Suzuki

(10) Patent No.: US 7,469,115 B2
(45) Date of Patent: Dec. 23, 2008

(54) METHOD FOR POSITIONING IMAGE BEARING MEMBER UNIT AND ROLLER UNIT IN IMAGE FORMING APPARATUS

(75) Inventor: Kenji Suzuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 210 days.

(21) Appl. No.: 11/091,453

(22) Filed: Mar. 29, 2005

(65) Prior Publication Data

US 2005/0220483 A1 Oct. 6, 2005

(30) Foreign Application Priority Data

Mar. 31, 2004 (JP) ..... 2004-107680

(51) Int. Cl.
*G03G 21/16* (2006.01)
*G03G 15/08* (2006.01)

(52) U.S. Cl. ..... 399/111; 399/121

(58) Field of Classification Search ..... 399/111, 399/121

See application file for complete search history.

(56) References Cited

U.S. PATENT DOCUMENTS 6,996,354 B2 2/2006 Kimura et al.
7,127,195 B2 10/2006 Kimura et al.
2003/0219286 A1 11/2003 Soda et al. ..... 399/297
2004/0101328 A1* 5/2004 Kimura et al. ..... 399/111
2007/0036584 A1 2/2007 Kimura et al.

FOREIGN PATENT DOCUMENTS

JP 07261493 A * 10/1995
JP 2001051468 A * 2/2001
JP 2004-53819 2/2004
JP 2004-94151 A 3/2004

OTHER PUBLICATIONS

Chinese Office Action issued on Oct. 12, 2007.

* cited by examiner

*Primary Examiner*—David M. Gray
*Assistant Examiner*—Erika J. Villaluna
(74) *Attorney, Agent, or Firm*—Fitzpatrick, Cella, Harper & Scinto

(57) ABSTRACT

The image forming apparatus includes a chassis of a main body of the image forming apparatus, an image bearing member unit; a roller unit, and a first image bearing member supporting member, wherein the image bearing member unit includes, a chassis; and a second image bearing member supporting member, and wherein the roller unit includes a chassis; a first roller supporting member, a second roller supporting member, a first roller unit positioning member; and a second roller unit positioning member that comes into contact with a member provided at a predetermined position on the chassis of the image bearing member unit. This improves position accuracy of a roller with respect to an image bearing member, and prevents generation of a defective image.

10 Claims, 7 Drawing Sheets

METHOD FOR POSITIONING IMAGE BEARING MEMBER UNIT AND ROLLER UNIT IN IMAGE FORMING APPARATUS

BACKGROUND OF THE INVENTION

1. Field of the Invention

The present invention relates to positioning of a roller unit in an image forming apparatus including an image bearing member unit in which a rotating image bearing member is provided and the roller unit in which a roller substantially parallel to a direction perpendicular to a rotating direction of the image bearing member is provided.

2. Related Background Art

Members that constitute an image forming apparatus are often integrated as a unit for easy maintenance.

Japanese Patent Application Laid-Open No. 2004-53819 discloses an example of an image forming apparatus including members as a unit.

In the image forming apparatus disclosed in Japanese Patent Application Laid-Open No. 2004-53819, for an image bearing member unit to be easily mountable to or detachable from a chassis of the image forming apparatus in a direction substantially parallel to a direction perpendicular to a rotation axis of the image bearing member.

A method shown in FIG. 6 has been used as a method for positioning an image bearing member unit A and a roller unit 5 in an image forming apparatus having a detachably mountable image bearing member unit as described above. For the image bearing member unit A to be mountable to or detachable from a chassis of the image forming apparatus in a direction perpendicular to a rotation axis of an image bearing member (the direction of arrow X in FIG. 6), a part to be supported 47 at one end part side (the side of a front side plate 101) of a shaft 45 of an image bearing member 4 is positioned with respect to a plate 81 of the image bearing member unit A in the direction of arrow X in FIG. 6.

On the other hand, a part to be supported 48 a at the other end part side (the side of a rear side plate 102) of the shaft 45 of the image bearing member 4 is positioned with respect to the rear side plate 102 of the chassis of the image forming apparatus for positioning the image bearing member 4 in the chassis of the image forming apparatus.

A roller unit 5 in which a roller member 51 is provided is positioned so that a positioning member 57 of the roller unit 5 comes into contact with a member 87 provided on the front side plate 101 of the chassis of the image forming apparatus on the side of the front side plate 101, and a positioning member 58 of the roller unit 5 comes into contact with a member 103 provided on the rear side plate 102 of the chassis of the image forming apparatus on the side of the rear side plate 102, and a distance between the shaft 45 of the image bearing member 4 and a shaft 51*a*' of the roller 51 is a desired distance.

However, when the roller unit is positioned by the above described method, position accuracy of the roller with respect to the image bearing member on the side of the front side plate 101 is poorer than positing accuracy of the roller with respect to the image bearing member on the side of the rear side plate 102, and the distance between the image bearing member and the roller on the side of the rear side plate 102 is not the desired distance, thereby generating a defective image.

SUMMARY OF THE INVENTION

Therefore, the purpose of the invention is to provide an image forming apparatus including an image bearing member unit detachably mountable to a chassis of the image forming apparatus substantially perpendicularly to a rotating direction of an image bearing member and a roller unit in which a roller substantially parallel to the direction substantially perpendicular to a direction of the image bearing member is provided, and capable of improving position accuracy of the roller with respect to the image bearing member and preventing generation of a defective image.

Another object of the invention is to provide an image forming apparatus including a chassis of a main body of the image forming apparatus, an image bearing member unit having an image bearing member rotating in a predetermined direction around a rotation axis of the image bearing member, said image bearing member unit being mountable to or detachable from the chassis of the main body of the image forming apparatus from a side of a first end part of said image bearing member in a direction substantially parallel to the rotation axis of said image bearing member, a roller unit having a roller substantially parallel to the rotation axis of the image bearing member; and a second image bearing member supporting member that supports a second part to be supported of the image bearing member placed on a side of a second end part of the image bearing member in the direction substantially parallel to the rotation axis of the image bearing member, and positions the image bearing member with respect to a predetermined position on the chassis of the main body of the image forming apparatus, wherein the image bearing member unit comprises a chassis of the image bearing member unit and a first image bearing member supporting member that supports a first part to be supported of the image bearing member placed on the side of a first end part of the image bearing member, and positions the image bearing member with respect to a predetermined position on the chassis of the image bearing member unit, and wherein the roller unit comprises a first roller supporting member that supports a first part to be supported of the roller placed on the side of the fist end part of the image bearing member, and positions the roller with respect to the roller unit, a second roller supporting member that supports a second part to be supported of the roller placed on the side of the second end part of the image bearing member, and positions the roller with respect to the roller unit a second roller unit positioning member that is provided at the side of the second end part of said image bearing member and comes into contact with a member provided at the predetermined position on the chassis of the main body of the image forming apparatus, and a first roller unit positioning member that is provided at the side of the first end part of said image bearing member and comes into contact with a member provided at the predetermined position on the chassis of the image bearing member unit.

DESCRIPTION OF THE PREFERRED EMBODIMENTS

Figure 2A:
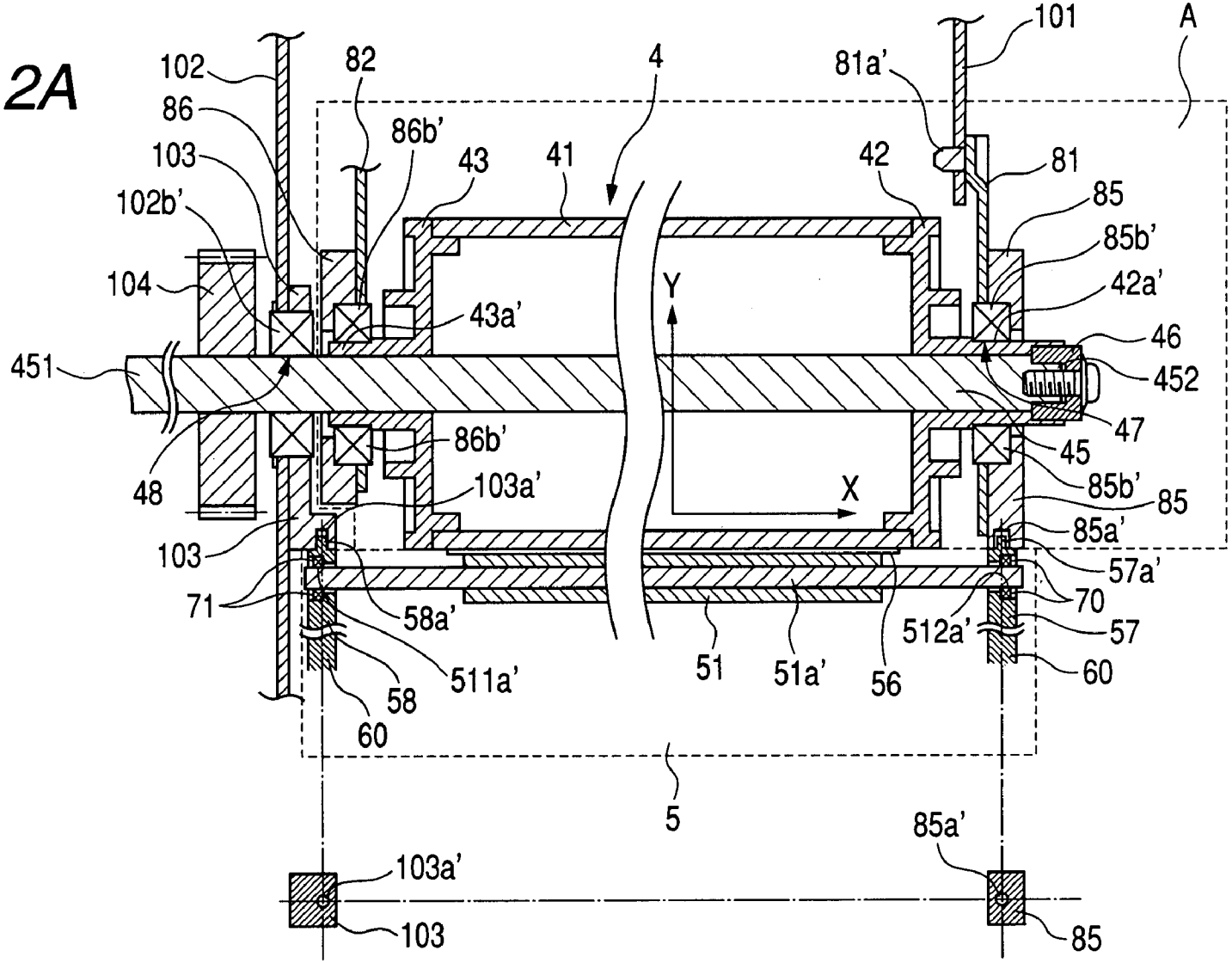
FIG. 2A shows a vertical sectional view of a configuration for positioning an intermediate transferring belt in Embodiment 1, and a view seen from below at around holes for positioning the intermediate transferring belt.

In the invention, as shown in FIG. 2A, intermediate transferring member positioning member (a first roller supporting member) 57 provided in an intermediate transferring device (a roller unit) 5 comes into contact with a member 85 provided in an image bearing member unit A for positioning on the side of an end part 452 (a first end part) of a photosensitive drum (an image bearing member) 4, thereby solving the above described problems.

Figure 6:
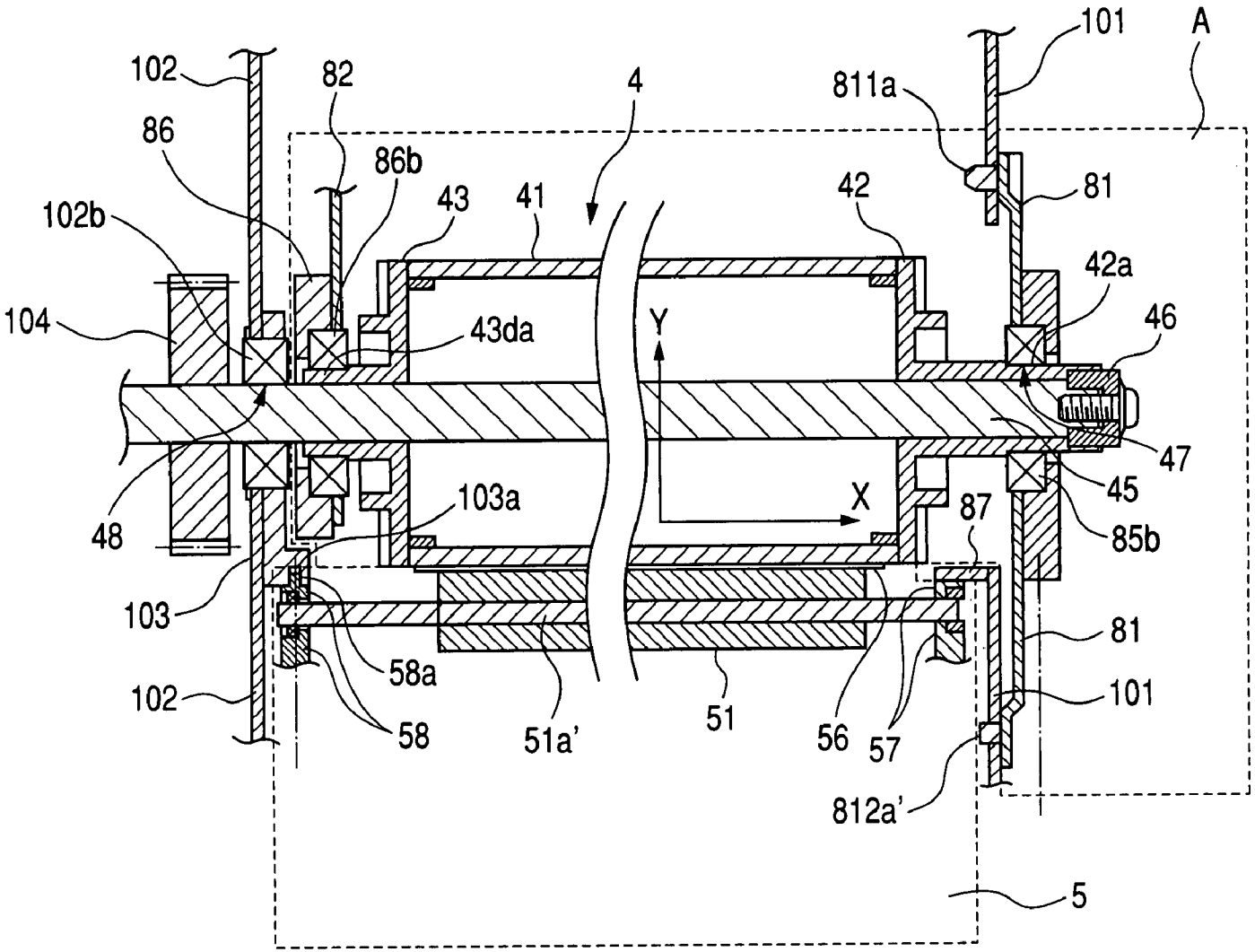
FIG. 6 is a front view for illustrating positioning of a roller unit in a conventional image forming apparatus.

The inventor has studied and found that poor position accuracy of a roller member 51 with respect to an image bearing member 4 on the side of a front side plate 101 in a conventional image forming apparatus in FIG. 6 is caused by the following reasons.

Specifically, on the side of a rear side plate 102, the image bearing member 4 and the roller unit 5 are both positioned with respect to the rear side plate 102.

On the other hand, on the side of the front side plate 101, the image bearing member 4 is positioned with respect to a plate 81 of an image bearing member unit A. The roller unit 5 is positioned with respect to the front side plate 101 of a chassis of the image forming apparatus.

The image bearing member 4 and the roller unit 5 are positioned with respect to different plates. At this time, the position accuracy of the roller 51 with respect to the image bearing member 4 is affected by joining of the front side plate 101 of the image bearing member unit A to the plate 81 of the roller unit. For the front side plate 101 and the plate 81, the position accuracy of the roller 51 with respect to the image bearing member 4 on the side of the front side plate 101 is poorer than the position accuracy on the side of the rear side plate 102 because of a protrusion part 81*a'*.

Then, a distance between a shaft 45 of the image bearing member 4 and a shaft 51*a*' of the roller 51 is not a desired distance, thereby generating a defective image.

Thus, in the invention, on the side of the front side plate 101, that is, the side of the end part 452 of the photosensitive drum 4, the intermediate transferring member positioning member 57 of the intermediate transferring device 5 comes into contact with the member 85 provided on a plate 81 (a predetermined plate of the image bearing member unit) on which a front drum supporting member 85*b*' (a first image bearing member supporting member) that supports a part to be supported 47 (a first part to be supported of the roller) on the side of the end part 452 of the photosensitive drum 4 is provided, thereby allowing the photosensitive drum 4 and the intermediate transferring device 5 to be positioned with respect to a common position (herein the plate 81) even on the side of the front side plate 101 and solving the above described problems. Now, the invention will be described in detail below.

The embodiments of the invention will be described with reference to the drawings. In the drawings, components denoted by the same reference numerals and characters have the same configurations or operations, and repeated descriptions thereof will be omitted as appropriate.

Embodiment 1

Figure 1:
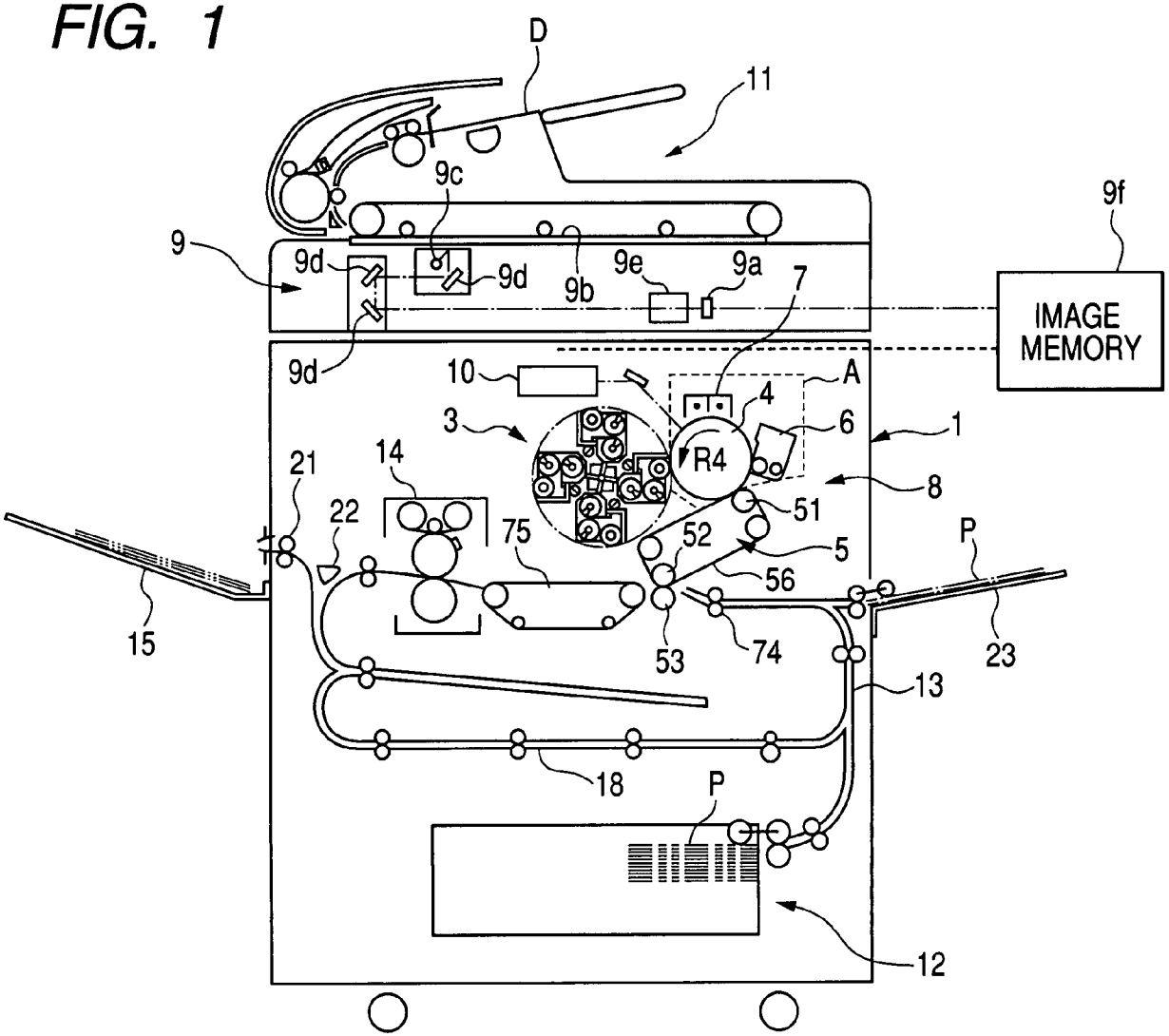
FIG. 1 is a front sectional view of an outline configuration of an image forming apparatus according to Embodiment 1.

FIG. 1 shows an image forming apparatus to which the invention may be applied. The image forming apparatus in FIG. 1 is a full color image forming apparatus with four colors using an intermediate transferring member, and FIG. 1 is a vertical view of an outline configuration thereof.

The outline configuration of the image forming apparatus will be described with reference to FIG. 1.

A main body 1 of the image forming apparatus (hereinafter simply referred to as "a main body of the apparatus") in FIG. 1 includes an original feeding part 11, an image reading part (a reader part) 9, an image forming part 8, and a conveying part 12 in order from above.

The original feeding part 11 is adapted to feed an original D to be read onto a copy board 9*b* and feed the original after being read out of the copy board 9*b*.

The image reading part 9 includes the copy board 9*b* on which the original D is placed, a light source 9*c* from which a light is emitted to the original, a plurality of mirrors 9*d* that reflect a reflected light from the original D, a lens 9*e* that forms an image from the reflected light, and a CCD 9*a* that converts an incident light from the lens to an electric signal, or the like. The electric signal from the CCD 9*a* is subjected to various types of processing by an image processing part (not shown) and then input to an image memory 9*f*.

The image forming part 8 includes a drum-shaped electrophotographic photosensitive member (hereinafter referred to as "a photosensitive drum") 4 as an image bearing member. The photosensitive drum 4 is supported rotatably in the direction of arrow R4 by the main body 1 of the apparatus. Around the photosensitive drum 4, a primary charging device 7 that uniformly charges a surface of the photosensitive drum 4, a laser exposure optical system 10 that causes the surface of the photosensitive drum 4 after being charged to be exposed to light based on an image signal from the image memory 9*f* to form an electrostatic latent image, a developing apparatus 3 that adheres toner to the electrostatic latent image to develop the latent image as a toner image, an intermediate transferring device 5 to which the toner image on the photosensitive drum 4 is transferred, and a photosensitive member cleaner 6 that cleans the surface of the photosensitive drum 4 are provided substantially in order in the rotating direction of the photosensitive drum 4.

At this time, a rear side plate 102 and a front side plate 101 are plates of a chassis that constitutes the main body of the apparatus. The photosensitive drum 4, the primary charging device 7 and the photosensitive member cleaner 6 are integrated as a unit to constitute an image bearing member unit A.

The intermediate transferring device 5 (a roller unit) includes an intermediate transferring belt (an intermediate transferring member) 56 as an intermediate transferring member spanning a plurality of rollers, the plurality of rollers that the intermediate transferring belt 56 spans, and an intermediate transferring member frame (a holding member: see FIG. 2A) 60 that supports the plurality of rollers, thereby constituting an intermediate transferring member unit. Among the plurality of rollers, a primary transferring roller (a roller) 51 presses the intermediate transferring belt 56 against the photosensitive drum 4 from a rear side thereof. This causes a primary transferring part to be formed between the photosensitive drum 4 and the intermediate transferring belt 56. Toner images of colors successively formed on the photosensitive drum 4 are successively subjected to primary transfer onto the intermediate transferring belt 56 and superposed on the intermediate transferring belt 56 in the primary transferring part. Among the plurality of rollers, a secondary transferring facing roller 52 presses the intermediate transferring belt 56 against a secondary transferring roller 53 from a rear side thereof. This causes a secondary transferring part to be formed between the secondary transferring roller 53 and the intermediate transferring belt 56. The toner images of the plurality of colors on the intermediate transferring belt 56 are collectively subjected to secondary transfer onto a recording material in the secondary transferring part.

In the image forming part 8, a fixing device 14 is provided that heats and pressurizes the toner images transferred in the secondary transferring part and fixes the toner images on the recording material P.

The conveying part 12 includes a sheet feeding cassette 17 that contains recording materials P, a conveying path 13 that guides a conveyed recording material P, a registration roller 74 that feeds the recording material P to the secondary transferring part (described later) at a predetermined timing, a conveying belt 75 that conveys the recording material P after the secondary transfer, a sheet delivering roller 21 that delivers the recording material P after the fixing, a sheet delivering tray 15 on which delivered recording materials P are piled, a flapper 22 that switches a conveying path for the recording material P after the fixing, a re-conveying path 18 through which the recording material P switched by the flapper 22 is guided in image forming on both sides of the recording material P, and a manual feeding tray 23 for manually feeding recording materials P.

Next, an operation of the image forming apparatus having the above described configuration will be described.

The photosensitive drum 4 is rotatably driven at a predetermined process speed in the direction of arrow R4 by drive means (not shown). The surface of the photosensitive drum 4 is uniformly charged at a predetermined polarity and potential by the primary charging device 7.

An electrostatic latent image is formed by the laser exposure optical system 10 on the surface of the photosensitive drum 4 after being charged. The laser exposure optical system 10 emits a laser light from a laser output part based on the image signal from the image memory 9*f*. The surface of the photosensitive drum 4 after being charged is exposed to the laser light and scanned via a polygon mirror or a reflective mirror. This causes the electrostatic latent image to be formed on the surface of the photosensitive drum 4.

The electrostatic latent image formed on the photosensitive drum 4 is developed by the developing apparatus 3. The developing apparatus 3 has a rotatable rotary 3*a* and developing devices of four colors incorporated in the rotary 3*a*, that is, the developing devices 3Y, 3M, 3C and 3K of yellow (Y), magenta (M), cyan (C) and black (K), and rotation of the rotary 3*a* causes a developing device to be used for development to be placed in a developing position facing the photosensitive drum 4. Toner is adhered to the electrostatic latent image on the photosensitive drum 4 by the developing device of the color placed in the developing position (for example, the developing device 3Y of yellow), and the electrostatic latent image is developed as a toner image.

The toner image of yellow formed on the photosensitive drum 4 is subjected to the primary transfer onto the intermediate transferring belt 56 by the primary transferring roller 51 in the primary transferring part.

Toner remaining on the surface of the photosensitive drum 4 (remaining toner) after the primary transfer of the toner image is removed by the photosensitive member cleaner 6, static is eliminated from the photosensitive drum 4 by a pre-exposure lamp (not shown), and then the photosensitive drum 4 is used for image forming of the next color.

The image forming processes of the charging, exposure, development, primary transfer and cleaning are performed for the three colors other than yellow. This allows the toner images of four colors to be transferred onto the intermediate transferring belt 56 and superposed.

The toner images of four colors on the intermediate transferring belt 56 are transferred to the recording material P in the secondary transferring part. The recording material P is fed from the sheet feeding cassette 17 or the manual feeding tray 23 to the secondary transferring part at a timing adjusted by the registration roller 74. The toner images of four colors on the intermediate transferring belt 56 are collectively subjected to the secondary transfer onto the fed recording material P by the secondary transferring roller 53.

The recording material P after the secondary transfer is conveyed to the fixing device 14 by the conveying belt 75, where the toner images are heated and pressurized to be fixed on the surface of the recording material P. The recording material P after the toner image fixing is delivered onto the sheet delivering tray 15, thereby completing full color image forming with four colors on one recording material P. When images are formed on both sides of the recording material P, the recording material P after the toner image fixing is once guided through the re-conveying path 18 and then fed to the image forming part again, and an image is also formed on a rear side in the same manner as described above.

Next, positioning of the primary transferring roller 51 with respect to the photosensitive drum 4 that is a characteristic feature of the invention will be described in detail.

FIG. 2A shows a section through a drum shaft of the photosensitive drum 4 and a shaft of the primary transferring roller 51. The right side in FIG. 2A corresponds to the front side of the main body 1 of the apparatus, and the left side in FIG. 2A corresponds to the rear side of the main body 1 of the apparatus. The upper and lower sides in FIG. 2A correspond to the upper and lower sides, respectively, of the main body 1 of the apparatus.

As shown in FIG. 2A, the photosensitive drum 4 includes a cylinder part 41, a front flange part 42 secured to a front end part of the cylinder part 41, a rear flange part 43 secured to a rear end part of the cylinder part 41, and a drum shaft 45 passing through boss parts 42*a*' and 43*a*' at the centers of the front and rear flange parts 42 and 43 in a front-rear direction.

An engaging member 46 is fastened by a screw to a front end part 452 (a second end part of an image bearing member) of the drum shaft 45, and the engaging member 46 causes the drum shaft 45 to engage the front flange part 42. The boss part 42*a*' of the front flange part 42 is rotatably supported by a bearing 85*b*' (a first image bearing member supporting member) held by a plate 81 (a predetermined plate of an image bearing member unit).

The bearing 85*b*' supports a part to be supported 47 (a second part to be supported of the image bearing member) placed on the side of the front end part 452 of the drum shaft 45.

A front drum supporting member 85 (a member provided on a predetermined plate of the image bearing member) is secured to a front plate 81 of a drum kit (an image bearing member unit), and the drum kit front plate 81 is secured to a main body front side plate 101 via a protrusion part 81*a*'.

The boss part 43*a*' of the rear flange part 43 is rotatably supported by a bearing 86*b* held by a rear drum supporting member 86. The rear drum supporting member 86 is secured to a drum kit rear plate 82.

Immediately behind the bearing 86*b*, another bearing (a second image bearing member supporting member) 102*b*' held by a main body rear plate (a predetermined plate of the chassis) 102 is provided. The bearing 102*b*' directly rotatably supports the drum shaft 45.

The bearing 102*b*' supports a part to be supported 48 (a second part to be supported of the image bearing member) placed on the side of a rear end part 451 (a second end part of the image bearing member) of the drum shaft 45.

Immediately behind the bearing 102*b*', a drive gear 104 for transmitting a drive force is secured to the drum shaft 45. A rear main body positioning member 103 is secured to the main body rear side plate 102. The main body positioning member (a member provided on a predetermined plate of the chassis) 103 and the front drum supporting member 85 (a member provided on a predetermined plate of the image bearing member unit) have a positioning hole 103*a*' and a positioning slot 85*a*', respectively, at bottoms thereof. FIG. 2A also shows a view seen from below at around the positioning hole 103*a*' and the positioning slot 85*a*'.

In the photosensitive drum 4, outer peripheral surfaces of the boss parts 42*a*' and 43*a*' are cut with reference to the cylinder part 41 after the front and rear flange parts 42 and 43 are connected to the cylinder part 41 in order to reduce runouts of the cylinder part 41 when the drum shaft 45 is supported at the boss parts 42*a*' and 43*a*' of the front and rear flange parts 42 and 43. This reduces runouts of an outer peripheral surface of the photosensitive drum 4 after assembly to 30 μm or less.

The position of the intermediate transferring belt 56 depends on the position of the primary transferring roller 51 that is a contact with the photosensitive drum 4, but in the embodiment, as shown in FIG. 2A front intermediate transferring member positioning member 57 (a second roller unit positioning member) and a rear intermediate transferring member positioning member 58 (a first roller unit positioning member) on the intermediate transferring member frame 60 (see FIG. 2A) as supporting members that support the intermediate transferring belt 56 via the primary transferring roller 51 and the secondary transferring facing roller 52 also serve as shaft supporting parts of a shaft 51*a*' of the primary transferring roller 51.

At this time, a part to be supported 512*a*' (a first part to be supported of a roller) of the shaft 51*a*' of the primary transferring roller 51 on the side of the end part 452 of the photosensitive drum 4 is supported by a bearing 70 (a first roller supporting member) provided near the front intermediate transferring member positioning member 57.

Also, a part to be supported 511*a*' (a second part to be supported of a roller) of the shaft 51*a*' of the primary transferring roller 51 on the side of the end part 451 of the photosensitive drum 4 is supported by a bearing 71 (a second roller supporting member) provided near the rear intermediate transferring member positioning member 58.

This facilitates ensuring position accuracy of the intermediate transferring belt 56 with respect to the photosensitive drum 4. A positioning pin 57*a*' of the intermediate transferring member positioning member 57 directly fits in the positioning slot 85*a*' in the front drum supporting member 85 rather than on the main body front side plate 101, thereby improving the position accuracy of the intermediate transferring belt 56 with respect to the photosensitive drum 4.

Specifically, the intermediate transferring member positioning member 57 (the first roller unit positioning member) is in contact with the member 85 (the member provided on the predetermined plate of the image bearing member unit) provided on the plate 81 (the predetermined plate of the image bearing member unit) of the image bearing member unit A.

On the other hand, at the rear side, a positioning pin 58*a*' of the intermediate transferring member positioning member 58 fits in the positioning pin 103*a*' in the main body positioning member 103 (the member provided on the predetermined plate of the chassis) secured to the main body rear side plate 102 rather than in the rear drum supporting member 86. For simply providing the position accuracy of the intermediate transferring belt 56 with respect to the photosensitive drum 4, it might be preferable that the positioning pin 58*a*' of the intermediate transferring member positioning member 58 is caused to fit in the rear drum supporting member 86. The drum shaft 45 is, however, stably supported at two points by the part to be supported 48 by the main body rear side plate 102 and the part to be supported 47 by the front drum supporting member 85. If a radial load is applied to a different position by abutment of the intermediate transferring member positioning member 58, rotation of the drum shaft 45 may change to cause a defective image such as a color shift or banding.

Thus, at the rear side, the positioning pin 58*a*' of the intermediate transferring member positioning member 58 is caused to fit in the main body positioning member 103 secured to the main body rear side plate 102 as described above. The rear side is a reference surface of the chassis that constitutes the main body 1 of the apparatus, and fits the main body positioning member 103 that directly fits the bearing 102*b* supporting the drum shaft 45, thereby providing desired accuracy of about ±50 μm with respect to the drum shaft 45 without problems.

As described above, according to the embodiment, a method for positioning the rear side having a drive source of the photosensitive drum 4 by the main body positioning member 103 secured to the rear side plate 102 that is the reference surface of the main body 1 of the apparatus, and directly positioning the front side by the front drum supporting member 85 that is desired to have position accuracy is preferable for delivering performance of the entire apparatus, as a method for positioning the intermediate transferring member in the image forming apparatus that transmits drive of the photosensitive drum 4 by the drum shaft 45 passing through the photosensitive drum 4.

Specifically, on the rear side plate 102 of the chassis as a predetermined plate of the chassis, the rear intermediate transferring member positioning member 58 is provided in contact with the member 103 (the member provided on the predetermined plate of the chassis).

The member 103 provided on the rear side plate 102 of the chassis is also in contact with a bearing 103'.

As shown in FIG. 2A, on the side of the rear side plate 102, the positioning pin 58' is inserted into and engaged to a positioning hole 103'. On the side of the front side plate 101, the positioning pin 57*a*' is inserted into and engaged to a positioning slot 85*a*'.

Figure 2B:
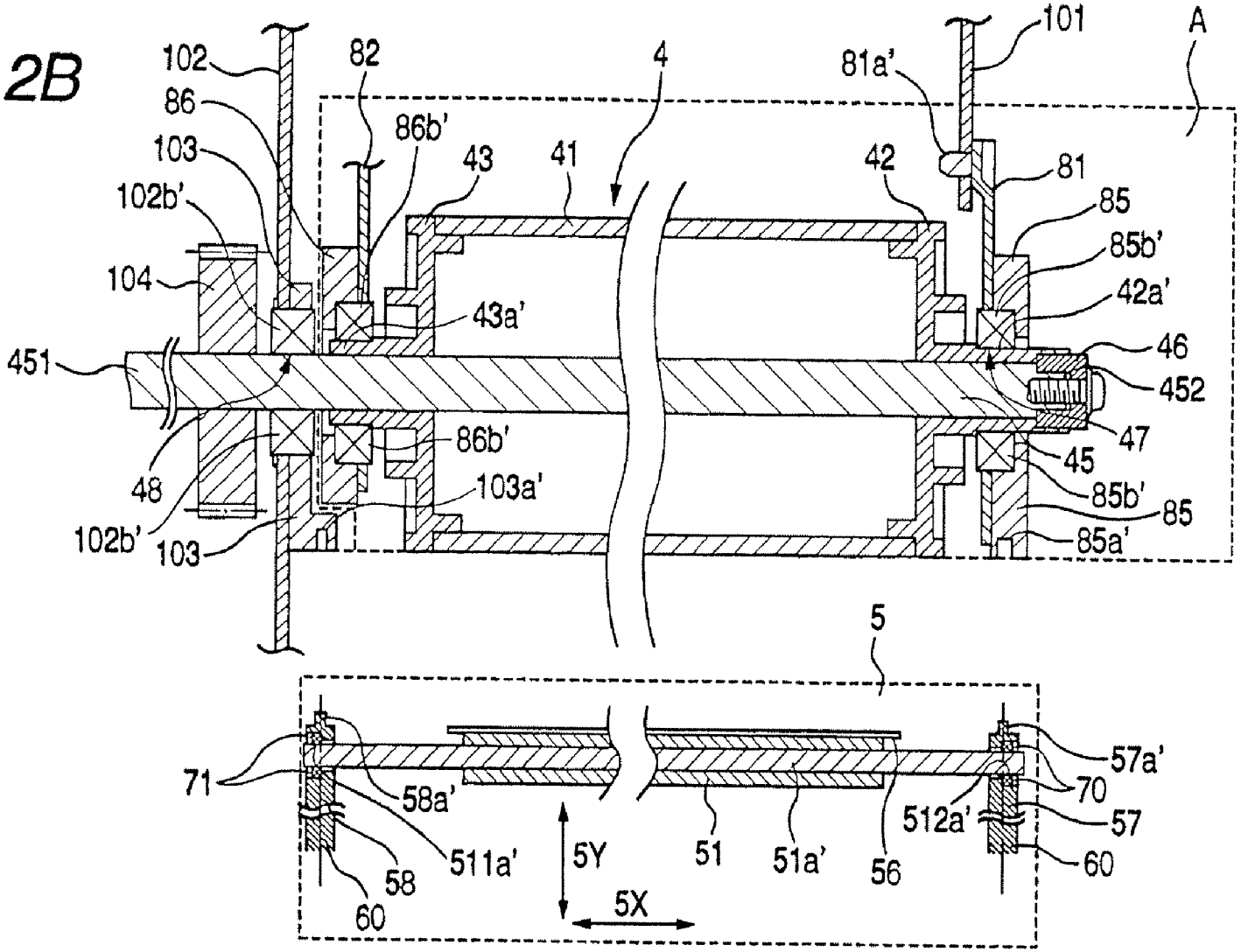
FIG. 2B shows a vertical sectional view and of a view seen from below in the condition that the roller unit is detached from the image bearing member.

As shown in FIG. 2B, the roller unit 5 is capable of moving in a direction parallel to the rotation axis of the image bearing member 4 shown as the arrow 5Y and detachable from the image bearing unit A. The roller unit 5 detached from the image bearing unit A in a direction parallel to the rotation axis of the image bearing member 4 shown as the arrow 5Y is also movable in a direction perpendicular to the rotation axis of the image bearing member 4 shown as the arrow 5X. The roller unit 5 is also detachable in an arrow direction 5X from a chassis of an image bearing apparatus on the side of the front side plate 101.

Further, according to the embodiment, the position accuracy of the intermediate transferring belt 56 with respect to the photosensitive drum 4 can be provided without an adjustment step, with satisfactory ease of service such as replacement of the intermediate transferring belt 56. This allows high quality images at low costs and low running costs to be both achieved.

Embodiment 2

Figure 3:
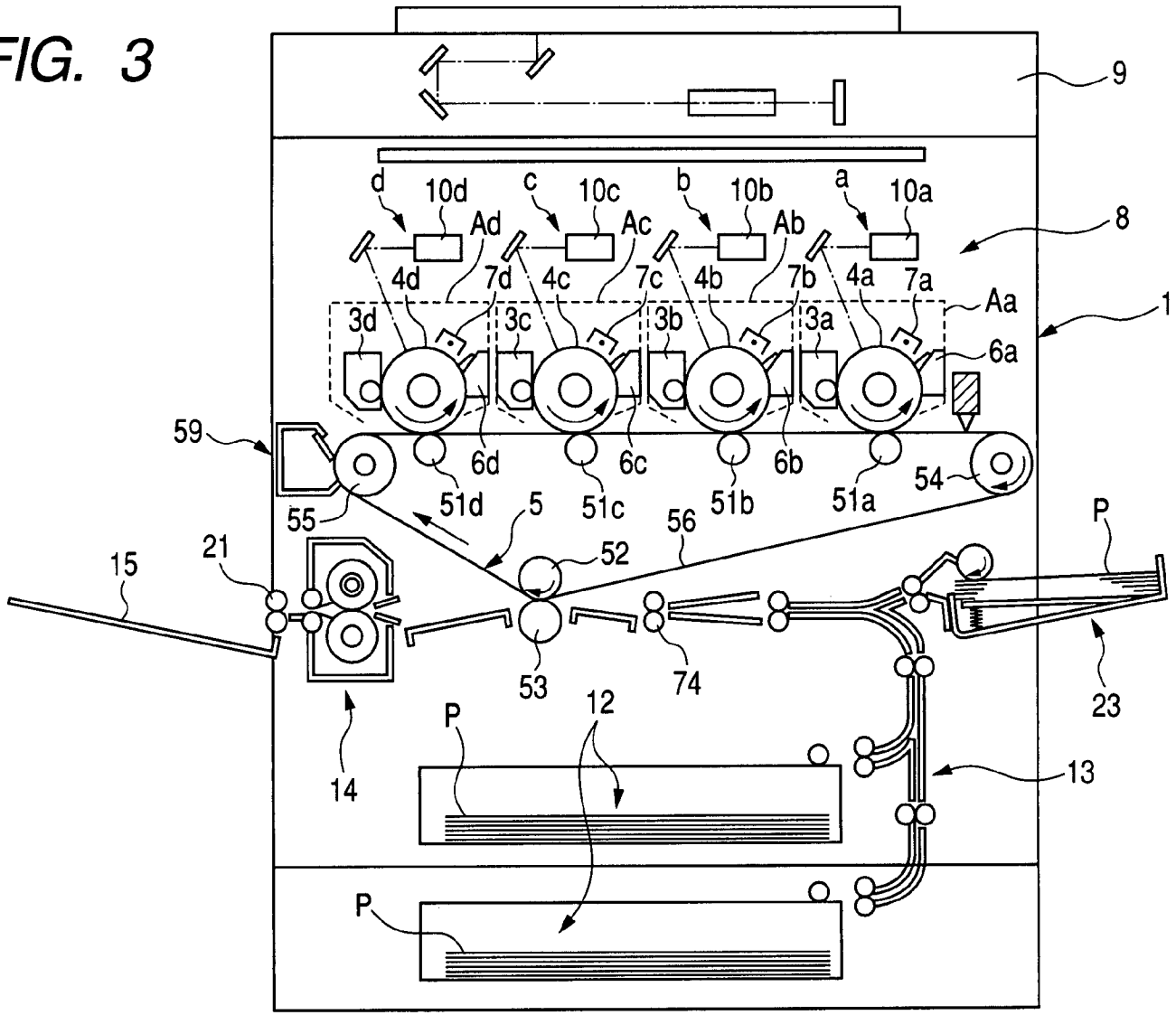
FIG. 3 is a front sectional view of an outline configuration of an image forming apparatus according to Embodiment 2.

Embodiment 2 will be described with reference to FIG. 3. FIG. 3 is a vertical sectional view of an outline configuration of an image forming apparatus according to the embodiment.

Embodiment 1 described above is an example of the invention applied to an image forming apparatus of one drum type having one photosensitive drum, and Embodiment 2 is an example of the invention applied to an image forming apparatus of four drum type having four photosensitive drums. In FIG. 3, components having the same configurations or operations as in FIG. 1 are denoted by the same reference numerals and characters, and repeated descriptions thereof will be omitted as appropriate.

The image forming apparatus in FIG. 3 includes four image forming stations that form toner images of different colors, that is, first, second, third and fourth image forming stations d, c, b and a, and photosensitive drums 4*d*, 4*c*, 4*b* and 4*a* as image bearing members are provided in the image forming stations, respectively.

The photosensitive drums 4*a*, 4*b*, 4*c* and 4*d* (hereinafter referred to as "4*a* to 4*d*" as appropriate) are rotatably supported by a main body 1 of the apparatus. Around the photosensitive drums 4*a* to 4*d*, primary charging devices 7*a* to 7*d*, laser exposure optical systems 10*a* to 10*d*, developing apparatus 3*a* to 3*d*, and photosensitive member cleaners 6*a* to 6*d* are provided. An intermediate transferring device 5 is provided below the photosensitive drums 4*a* to 4*d*.

The intermediate transferring device 5 includes an endless intermediate transferring belt 56, three rollers that the intermediate transferring belt 56 spans, that is, a drive roller 54, a driven roller 55 and a secondary transferring facing roller 52, and primary transferring rollers 51*a* to 51*d* that press the intermediate transferring belt 56 against the photosensitive drums 4*a* to 4*d* and perform primary transfer of toner images on the photosensitive drums 4*a* to 4*d* onto the intermediate transferring belt 56. A secondary transferring roller 53 that performs collective secondary transfer of the toner images of a plurality of colors on the intermediate transferring belt 56 to a recording material P is provided at a position corresponding to the secondary transferring facing roller 52, outside the intermediate transferring belt 56.

In the laser exposure optical systems 10*a* to 10*d*, an image signal from an image reading part 9 is once stored in an image memory and then converted to an optical signal in a laser output part, and a laser light converted to the optical signal is reflected by a polygon mirror and applied to surfaces of the photosensitive drums 4*a* to 4*d* (exposure) via lenses and reflection mirrors.

In image forming by an image forming part 8, the photosensitive drums 4*a* to 4*d* are rotated, the photosensitive drums 4*a* to 4*d* after elimination of static by a pre-exposure lamp (not shown) are uniformly charged by the primary charging devices 7*a* to 7*d* and exposed to the laser light to form electrostatic latent images on the photosensitive drums 4*a* to 4*d*. Next, the electrostatic latent images on the photosensitive drums 4*a* to 4*d* are developed by developing apparatuses 3*a* to 3*d* to form images (toner images) by toner containing resin and pigments as a base on the photosensitive drums 4*a* to 4*d*. The toner images of different colors on the photosensitive drums 4*a* to 4*d* are subjected to primary transfer onto the intermediate transferring belt 56 in order from the photosensitive drums 4*a* to 4*d* on the left side so that the toner images are superposed on the intermediate transferring belt 56 without a color shift. This causes the toner images of four colors to be superposed on the intermediate transferring belt 56. The toner images are fed to a secondary transferring part by rotation of the intermediate transferring belt 56 in the direction of arrow.

On the other hand, the recording material P is conveyed one by one by sheet feeding means from a sheet feeding cassette 17*a*, subjected to correction of skew in a registration roller 74, and conveyed to the secondary transferring part between the secondary transferring roller 53 and the intermediate transferring belt 56 at a desired timing.

The recording material P after the toner image transfer is conveyed to a fixing device 14, where the toner images are heated and pressurized to be fixed on the surface of the recording material P. The recording material P after the toner image fixing is delivered onto a sheet delivering tray 15 by a sheet delivering roller 21, thereby completing full color image forming with four colors on the recording material P. Toner remaining on the surface (remaining toner) of the intermediate transferring belt 56 after the toner image transfer is removed by a belt cleaner 59, and then the intermediate transferring belt 56 is used for the next secondary transfer.

Now, positioning of the intermediate transferring belt 56 with respect to the photosensitive drums 4*a* to 4*d* that is a characteristic feature of the invention will be described in detail with reference to FIGS. 4 and 5.

Figure 4:
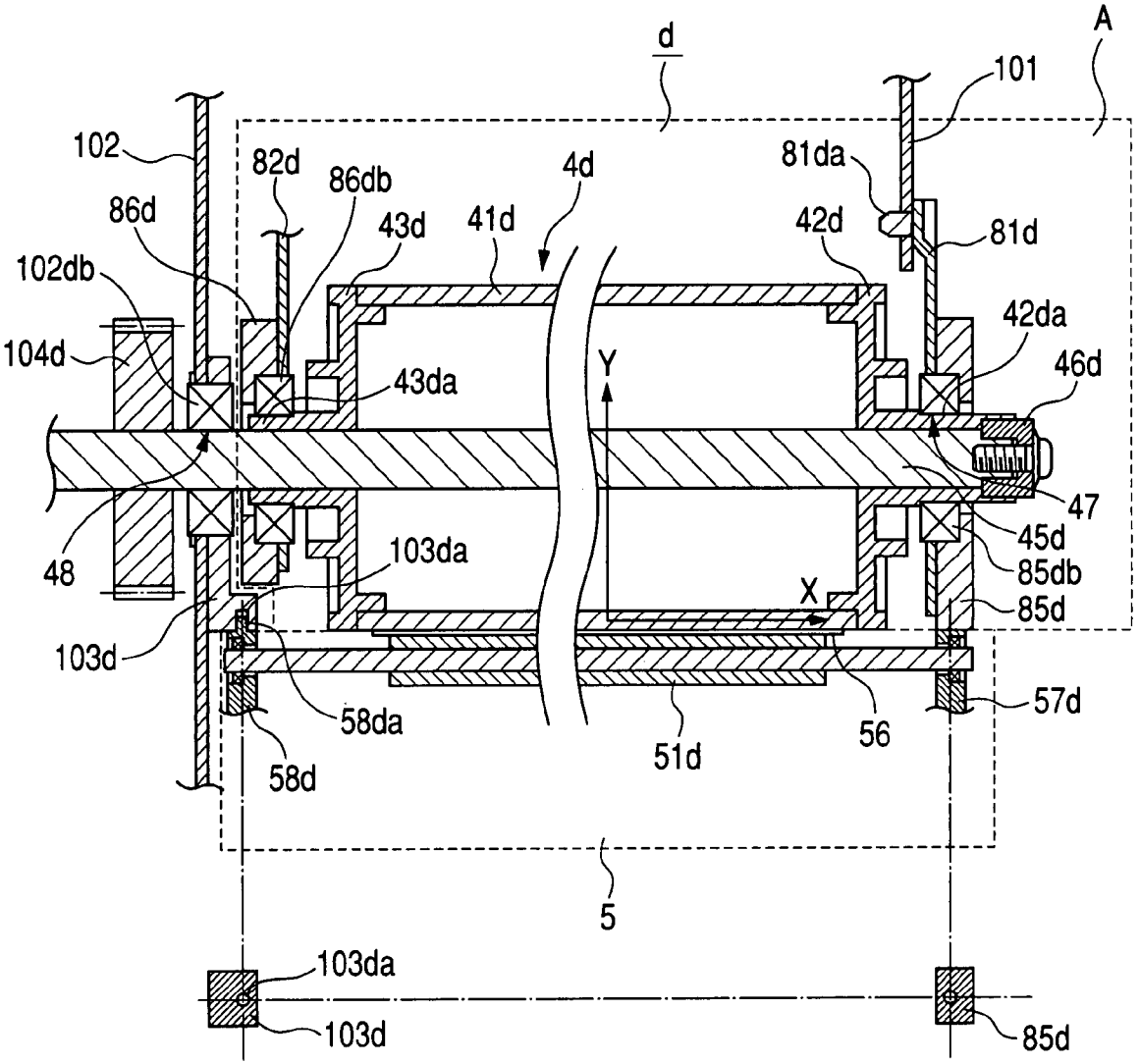
FIG. 4 shows a vertical sectional view of a configuration for positioning an intermediate transferring belt in a first image forming station in Embodiment 2; and a view seen from below at around holes for positioning the intermediate transferring belt.
Figure 5:
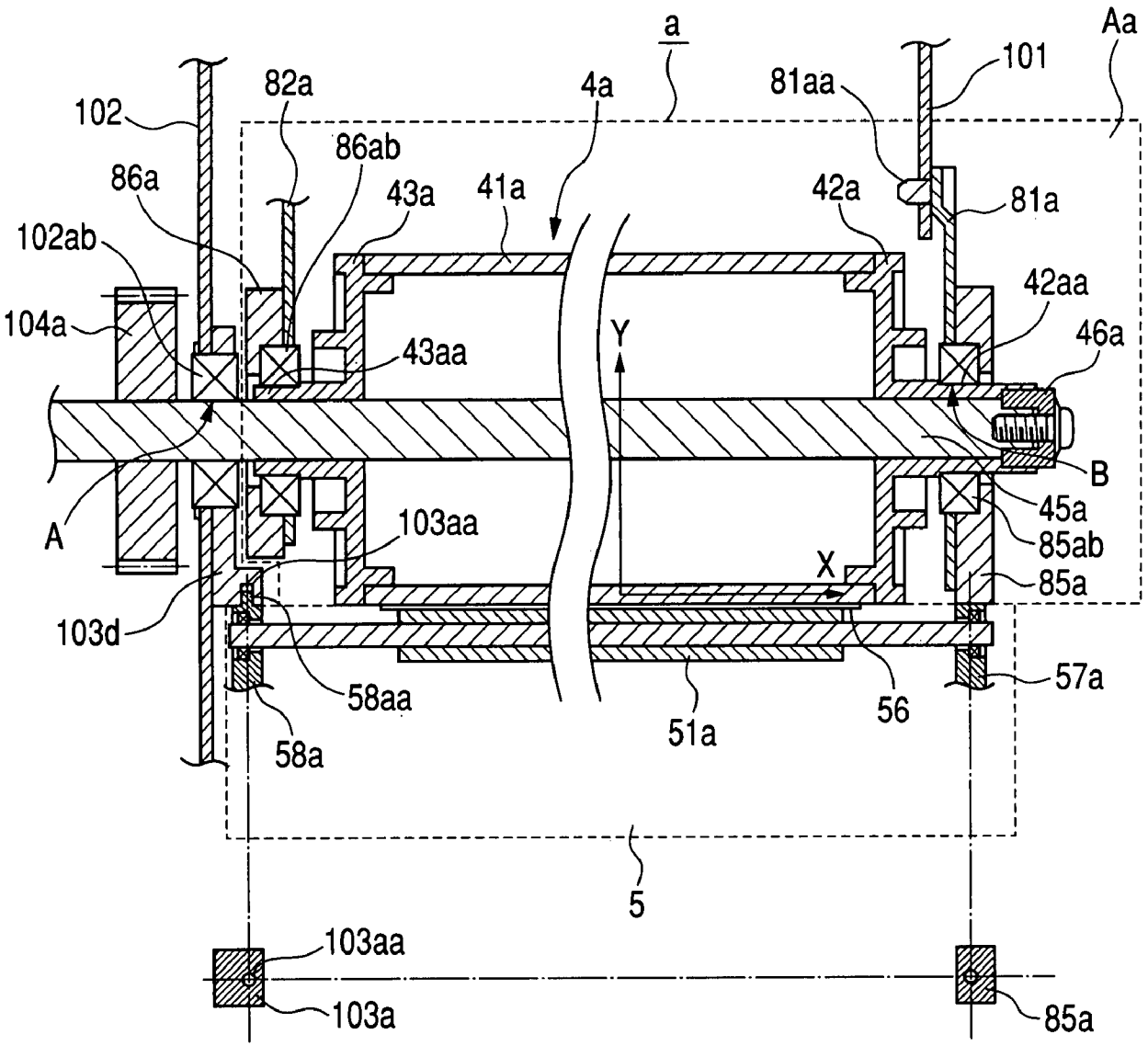
FIG. 5 shows a vertical sectional view of a configuration for positioning an intermediate transferring belt in a fourth image forming station in Embodiment 2 and a view seen from below at around holes for positioning the intermediate transferring belt.

FIG. 4 shows a section through a drum shaft of the photosensitive drum 4*d* and a shaft of the primary transferring roller 51*d* in the image forming station d, and FIG. 5 shows a section through a drum shaft of the photosensitive drum 4*a* and a shaft of the primary transferring roller 51*a* in the image forming station a. In FIGS. 4 and 5, the right sides correspond to the front side of the main body 1 of the apparatus, and the left sides correspond to the rear side of the main body 1 of the apparatus. The upper and lower sides in FIGS. 4 and 5 correspond to the upper and lower sides, respectively, of the main body 1 of the apparatus.

In FIGS. 4 and 5, reference numeral 101 denotes the front side plate of the main body; 102 denotes a rear side plate of the main body; 81*a* and 81*d* denote drum kit front plates of the fourth and the first image forming stations a and d; 82*a* and 82*d* denote drum kit rear plates of the fourth and the first image forming stations a and d; 45*a* and 45*d*, denote drum shafts of the fourth and the first image forming stations a and d; 46*a* and 46*d* denote engaging members of the fourth and the first image forming stations a and d; 85*a* and 85*d* denote front drum supporting members of the fourth and the first image forming stations a and d; 86*a* and 86*d* denote rear drum supporting members of the fourth and the first image forming stations a and d; 103*a* and 103*d* denote main body positioning members; 57*a* and 57*d* denote front intermediate transferring member positioning members; and 58*a* and 58*d* denote rear intermediate transferring member positioning members.

An intermediate transferring member frame 60 is positioned at one point by a positioning pin 58*da* of the intermediate transferring member positioning member 58*d* fitting in a positioning hole 103*da* of the main body positioning member 103*d* on the main body rear side plate 102 at the back of the first image forming station d (FIG. 4). The intermediate transferring member frame 60 is positioned at another point by a positioning pin 58*aa* of the intermediate transferring member positioning member 58*a* fitting in a positioning hole

103*aa* of the main body positioning member 103*a* on the main body rear side plate 102 at the back of the fourth image forming station a (FIG. 5). On the forward side, the intermediate transferring member positioning members 57*d* and 57*a* abut against the front drum supporting members 85*d* and 85*a* to provide restriction in the height direction.

Also in Embodiment 2, like Embodiment 1, the position of the intermediate transferring belt 56 depends on the positions of the primary transferring rollers 51*a* to 51*d* that are contacts with the photosensitive drums 4*a* to 4*d*, but the intermediate transferring member positioning members 57*d* and 58*a* on the intermediate transferring member frame also serve as shaft supporting members of the primary transferring rollers 51*a* and 51*d*, thereby easily providing position accuracy of the intermediate transferring belt 56 with respect to the photosensitive drums 4*a* to 4*d*.

As described above, according to the embodiment, a method for positioning the rear side having a drive source of the drum by the positioning member provided on the rear side plate 102 that is the reference surface of the main body 1 of the apparatus, and directly positioning the front side by the front drum supporting members 85*a* and 85*d* that are desired to have position accuracy is preferable for delivering performance of the entire apparatus, as a method for positioning the intermediate transferring member in the image forming apparatus that transmits drive of the photosensitive drums 4*a* to 4*d* by the drum shafts 45*a* to 45*d* passing through the photosensitive drums 4*a* to 4*d*.

Further, according to the embodiment, the position accuracy of the intermediate transferring belt 56 with respect to the plurality of photosensitive drums 4 can be provided without an adjustment step, with satisfactory ease of service such as replacement of the intermediate transferring belt 56. This allows high quality images at low costs and low running costs to be both achieved.

This application claims priority from Japanese Patent Application No. 2004-107680 filed Mar. 31, 2004, which is hereby incorporated by reference herein.

What is claimed is:

1. An image forming apparatus comprising:

a first side plate provided on said image forming apparatus;

an image forming unit to form a toner image, said image forming unit having an image bearing member, a frame provided at a position at which the frame faces to said first side plate and a first support portion to support the image bearing member with regard to the frame, said image forming unit being inserted into said image forming apparatus from said first side plate;

a second side plate provided on said image forming apparatus and at a position at which said second side plate faces to said first side plate, wherein at least a part of said image forming unit is provided in a space between said first side plate and said second side plate;

a shaft provided in said image forming apparatus, said shaft extending through the image bearing member and supporting said image bearing member;

a second support portion provided at said second side plate, said second support portion supporting said shaft;

a transfer unit that have a transfer member to transfer an image formed on said image bearing member;

a first positioning portion provided at said first plate side of said transfer unit, said first positioning portion determining a position of said transfer unit with regard to said shaft;

a second positioning portion provided at said second plate side of said transfer unit, said second positioning portion determining a position of said transfer unit with regard to said shaft;

a first positioned portion provided in said image forming unit, said first positioned portion abutting against said first positioning portion to be positioned by said first positioning portion; and a second positioned portion provided on said second side plate, said second positioned portion abutting against said second positioning portion to be positioned by said second positioning portion.

2. An image forming apparatus according to claim 1, wherein the support portion is a bearing to support said shaft, and wherein said second plate has the bearing.

3. An image forming apparatus according to claim 2, wherein said first positioned portion is a fit in member which is fitted into the bearing.

4. An image forming apparatus according to claim 1, wherein said second support portion is a bearing to support said image bearing member, and wherein the frame has the bearing.

5. An image forming apparatus according to claim 4, wherein said first positioned portion is an fit in member which is fitted into the bearing.

6. An image forming apparatus according to claim 1, wherein said transfer unit has an intermediate transfer member that bears a toner image transferred from the image bearing member by the transfer member.

7. An image forming apparatus according to claim 1, wherein said image forming unit has a fit in portion in which said first side plate fits.

8. An image forming apparatus according to claim 1, further comprising a fixing portion in which said shaft and the image bearing member are fixed.

9. An image forming apparatus according to claim 1, wherein said first and second positioning portions support the transfer member.

10. An image forming apparatus according to claim 1, wherein said image forming unit is provided at the frame side of said second side plate and supports the image bearing member with regard to the frame.

* * * * *